US006725934B2

(12) United States Patent
Coronado et al.

(10) Patent No.: US 6,725,934 B2
(45) Date of Patent: Apr. 27, 2004

(54) EXPANDABLE PACKER ISOLATION SYSTEM

(75) Inventors: Martin P. Coronado, Houston, TX (US); Edward T. Wood, Kingwood, TX (US); Benn A. Voll, Houston, TX (US); Mohamed F. Khodaverdian, The Woodlands, TX (US); Ray P. Vincent, Jr., Houston, TX (US); Van Nhat Ho, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 82 days.

(21) Appl. No.: 10/026,031

(22) Filed: Dec. 19, 2001

(65) Prior Publication Data

US 2002/0092654 A1 Jul. 18, 2002

Related U.S. Application Data

(60) Provisional application No. 60/257,224, filed on Dec. 21, 2000.

(51) Int. Cl.[7] ..... E21B 43/14; E21B 33/10

(52) U.S. Cl. ..... 166/313; 166/382; 166/387

(58) Field of Search ..... 166/313, 386, 166/206, 207, 227, 230, 387, 187, 382

(56) References Cited

U.S. PATENT DOCUMENTS

| | | | | | |
|---|---|---|---|---|---|
| 3,477,506 | A | * | 11/1969 | Malone | 166/207 |
| 5,718,288 | A | * | 2/1998 | Bertet et al. | 166/287 |
| 5,901,789 | A | | 5/1999 | Donnelly et al. | |
| 6,263,966 | B1 | | 7/2001 | Haut et al. | |
| 6,415,509 | B1 | * | 7/2002 | Echols et al. | 29/896.62 |
| 6,478,091 | B1 | * | 11/2002 | Gano | 166/373 |
| 6,478,092 | B2 | * | 11/2002 | Voll et al. | 166/378 |
| 2002/0139540 | A1 | * | 10/2002 | Lauritzen | 166/387 |
| 2002/0162664 | A1 | * | 11/2002 | Bode et al. | 166/380 |

FOREIGN PATENT DOCUMENTS

| | | |
|---|---|---|
| EP | 89309586.9 | 3/1990 |
| GB | 2336383 | 10/1999 |
| GB | 2343691 | 5/2000 |

* cited by examiner

*Primary Examiner*—Hoang Dang
(74) *Attorney, Agent, or Firm*—Steve Rosenblatt

(57) ABSTRACT

A completion technique to replace cementing casing, perforating, fracturing, and gravel packing with an open hole completion is disclosed. Each zone to be isolated by the completion assembly features a pair of isolators, which are preferably tubular with a sleeve of a sealing material such as an elastomer on the outer surface. The screen is preferably made of a weave in one or more layers with a protective outer, and optionally an inner, jacket with openings. The completion assembly can be lowered on rigid or coiled tubing which, internally to the completion assembly, includes the expansion assembly. The expansion assembly is preferably an inflatable design with features that provide limits to the delivered expansion force and/or diameter. A plurality of zones can be isolated in a single trip.

24 Claims, 20 Drawing Sheets

EXPANDABLE PACKER ISOLATION SYSTEM

PRIORITY INFORMATION

This application claims the benefit of U.S. Provisional Application No. 60/257,224, filed on Dec. 21, 2000.

FIELD OF THE INVENTION

The field of this invention is one-trip completion systems, which allow for zone isolation and production using a technique for expansion of screens and isolators, preferably in open hole completions.

BACKGROUND OF THE INVENTION

Typically zonal isolation is desirable in wells with different pressure regimes, incompatible reservoir fluids, and varying production life. The typical solution to this issue in the past has been to cement and perforate casing. Many applications further required gravel packing adding an extra measure of time and expense to the completion. The cemented casing also required running cement bond logs to insure the integrity of the cementing job. It was not unusual for a procedure involving cemented casing, gravel packing and zonal isolation using packers to take 5–20 days per zone and cost as much or over a million dollars a zone. Use of cement in packers carried with it concerns of spills and extra trips into the well. Frequently fracturing techniques were employed to increase well productivity but cost to complete was also increased. Sand control techniques, seeking to combine gravel packing and fracturing, also bring on risks of unintended formation damage, which could reduce productivity.

In open hole completions, gravel packing was difficult to effectively accomplish although there were fewer risks in horizontal pay zones. The presence of shale impeded the gravel packing operation. Proppant packs were used in open hole completions, particularly for deviated or horizontal open hole wells. Proppant packing involved running a screen in the hole and pumping proppants outside of it. Proppants such as gravel or ceramic beads were effective to control cave-ins but still allowed water or gas coning and breakthroughs. Proppant packs have been used between activated isolation devices such as external casing packers in procedures that were complex, time consuming, and risky. More recently, a new technique which is the subject of a co-pending patent application also assigned to Baker Hughes Incorporated a refined technique has been developed wherein a proppant pack is delivered on both sides of a non-activated annular seal. In this technique the seal can thereafter be activated against casing or open hole. While this technique involved improved zonal isolation, it was still costly and involved complex delivery tools and techniques for the proppant.

Shell Oil Company has disclosed more recently, techniques for expansion of slotted liners using force driven cones. Screens have been mechanically expanded, in an effort to eliminate gravel packing in open hole completions. The use of cones to expand slotted liners suffered from several weaknesses. The structural strength of the screens or slotted liners being expanded suffered as a tradeoff to allow the necessary expansion desired. When placed in service such structures could collapse at differential pressures on expanded screens of as low as 2–300 pounds per square inch (PSI). Expansion techniques suffered from other shortcomings such as the potential for rupture of a tubular or screen upon expansion. Additionally, where the well bore is irregular the cone expander will not apply uniform expansion force to compensate for void areas in the well bore. This can detract from seal quality. Cone expansion results in significant longitudinal shrinkage, which potentially can misalign the screen being expanded from the pay zone, if the initial length is sufficiently long. Due to longitudinal shrinkage, overstress can occur particularly when expanding from bottom up. Cone expansions also require high pulling forces in the order of 250,000 pounds. Slotted liner is also subject to relaxation after expansion. Cone expansions can give irregular fracturing effect, which varies with the borehole size and formation characteristics.

Accordingly the present invention has as its main objective the ability to replace traditional cemented casing completion procedures. This is accomplished by running isolators in pairs for each zone to be produced with a screen in between. The screen and isolators are delivered in a single trip and expanded down hole using an inflatable device to preferably expand the isolators. The screens can also be similarly expanded using an inflatable tool or by virtue of mechanical expansion, depending on the application. Each zone can be isolated in a single trip. The completion assembly and the expansion tool can selectively be run in together or on separate trips. These and other features of the invention can be more readily understood by a review of the description of the preferred embodiment, which appears below.

SUMMARY OF THE INVENTION

A completion technique to replace cementing casing, perforating, fracturing, and gravel packing with an open hole completion is disclosed. Each zone to be isolated by the completion assembly features a pair of isolators, which are preferably tubular with a sleeve of a sealing material such as an elastomer on the outer surface. The screen is preferably made of a weave in one or more layers with a protective outer, and optionally an inner, jacket with openings. The completion assembly can be lowered on rigid or coiled tubing which, internally to the completion assembly, includes the expansion assembly. The expansion assembly is preferably an inflatable design with features that provide limits to the delivered expansion force and/or diameter. A plurality of zones can be isolated in a single trip.

DETAILED DESCRIPTION OF THE DRAWINGS

FIGS. 1*a–d*, are a sectional elevation view of the open hole completion assembly at the conclusion of running in;

FIGS. 2*a–d*, are a sectional elevation view of the open hole completion assembly showing the upper optional packer in a set position;

FIGS. 3*a–d*, are a sectional elevation view of the open hole completion assembly with a zone isolated at its lower end;

FIGS. 4*a–d*, are a sectional elevation view of the open hole completion assembly with a zone isolated at its upper end;

FIGS. 5*a–d*, are a sectional elevation of the open hole completion assembly in the production mode;

Figure 8A:
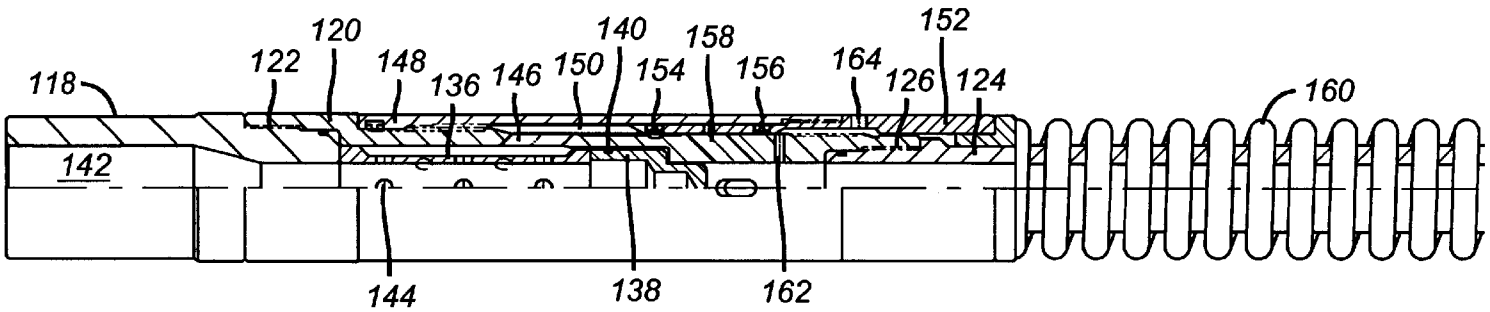
Figure 9A:
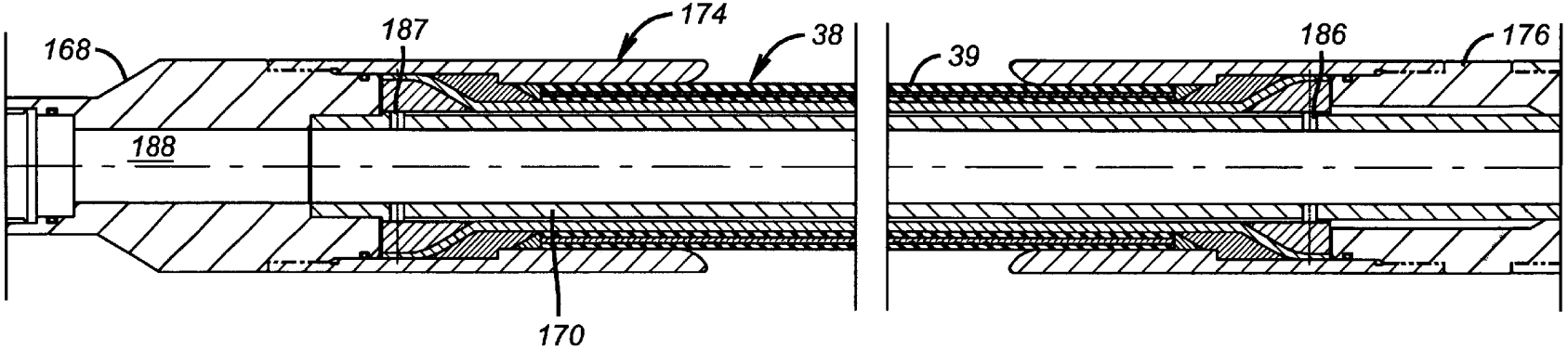
Figure 8B:
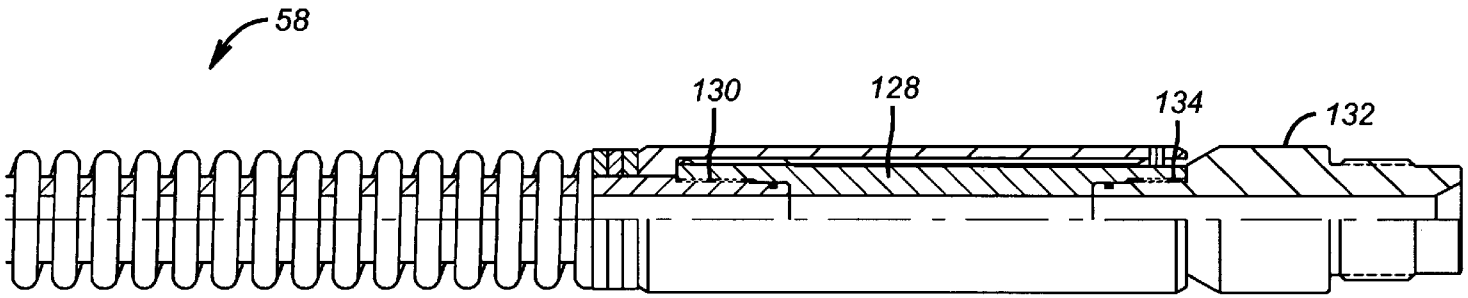
Figure 9B:
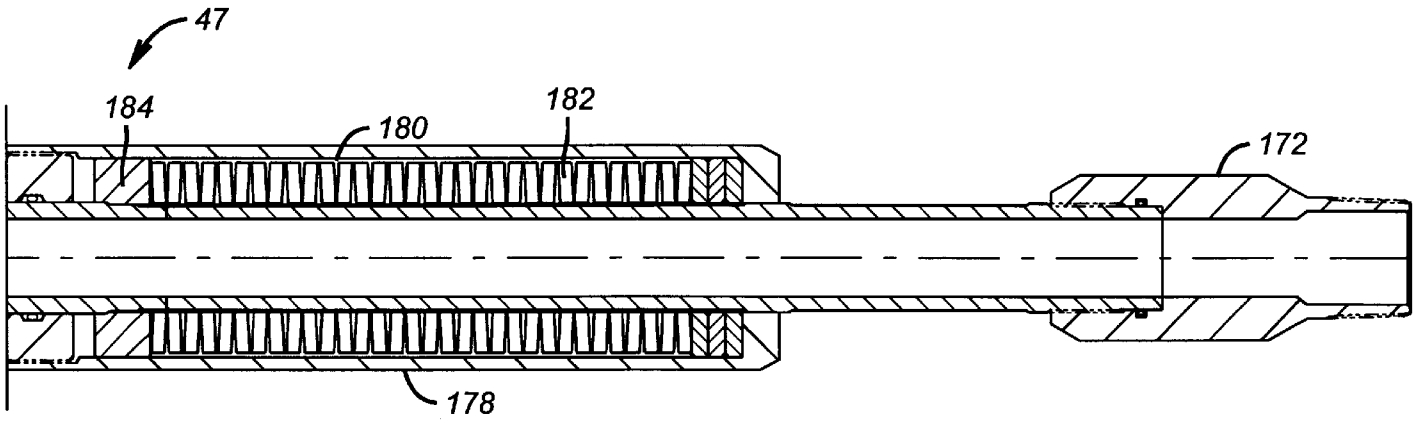
Figure 10:
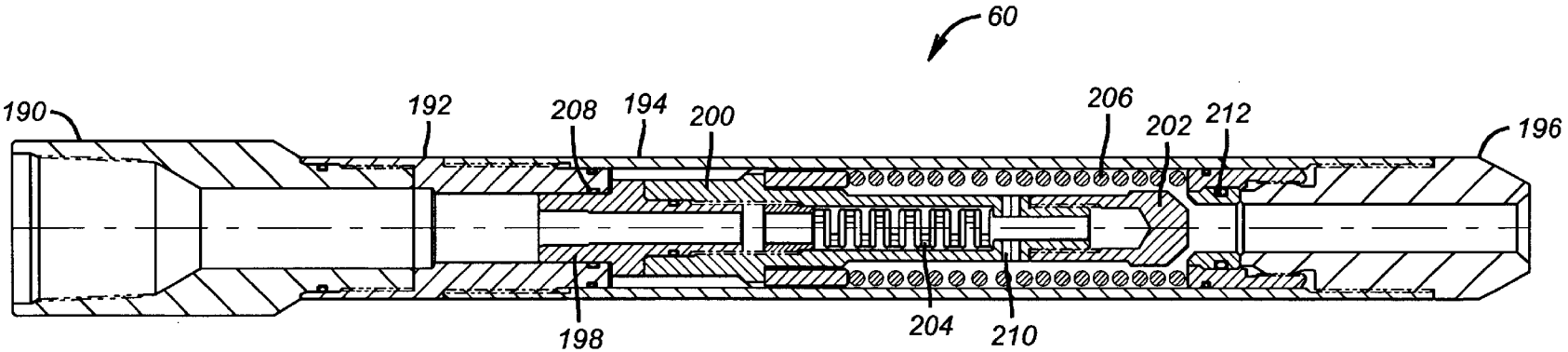
Figure 11:
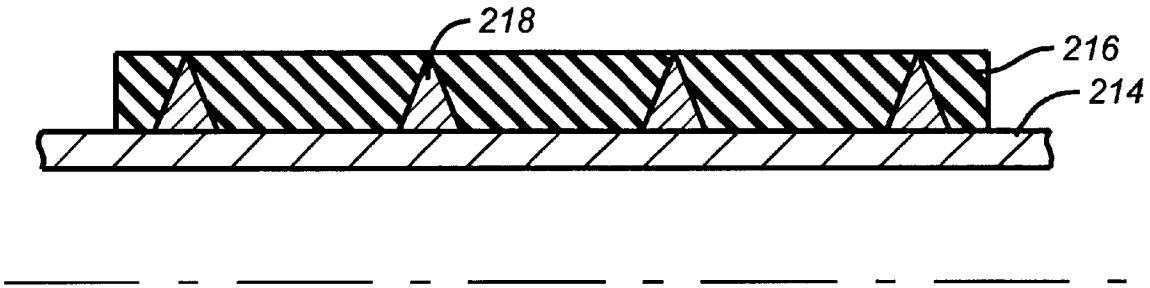
Figure 12:
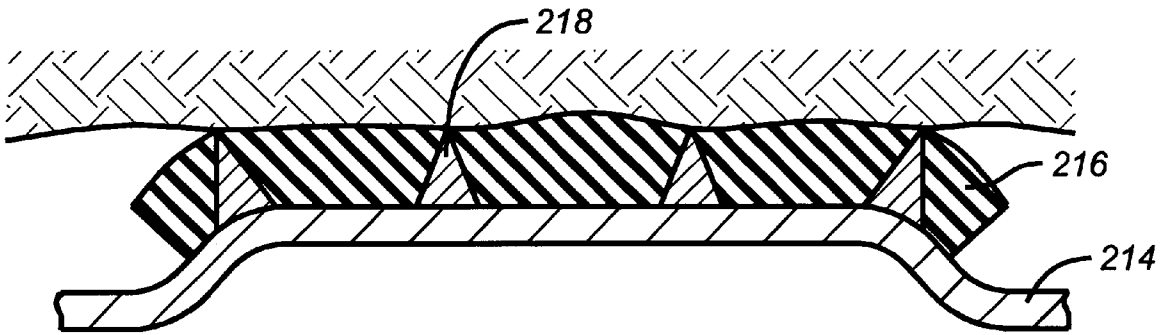
Figure 13:
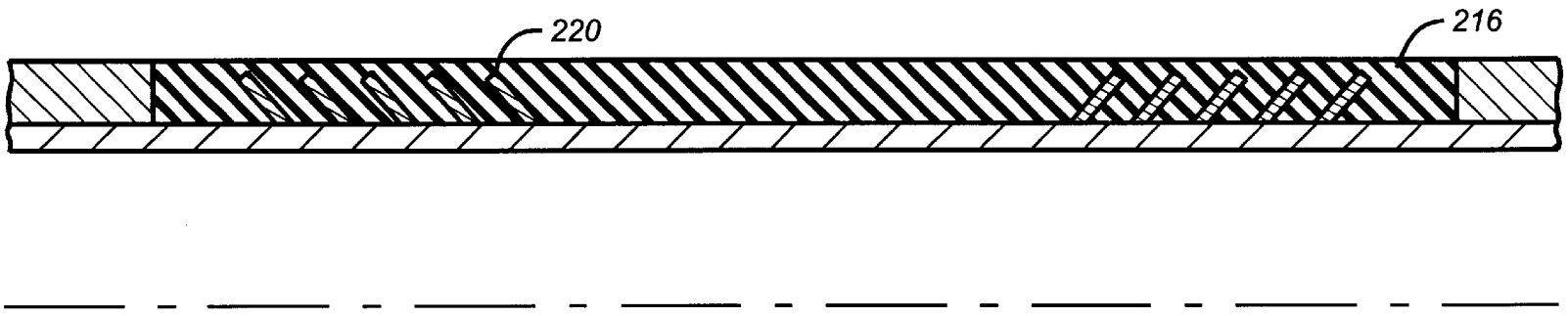
Figure 14:
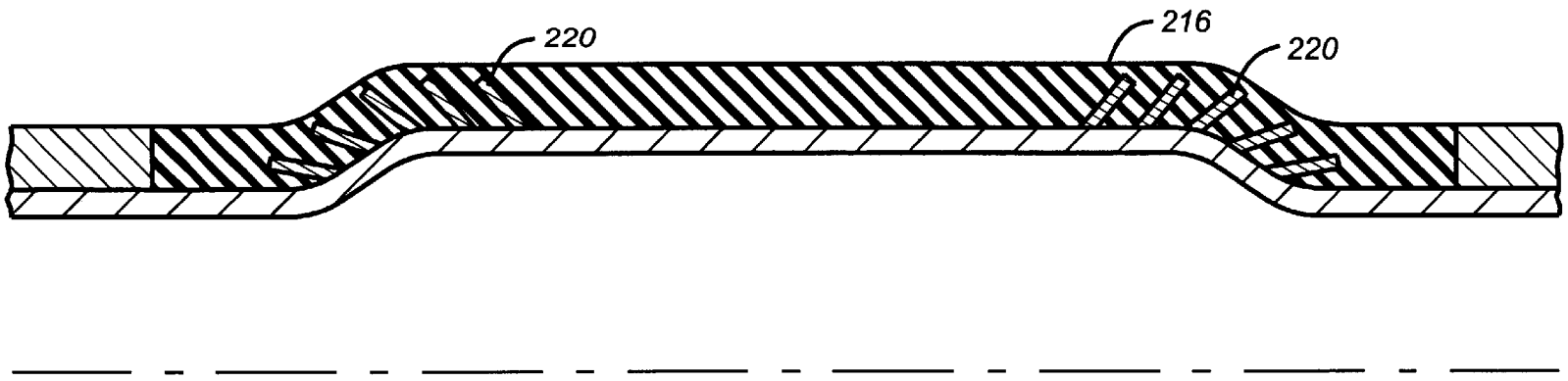
Figure 15:
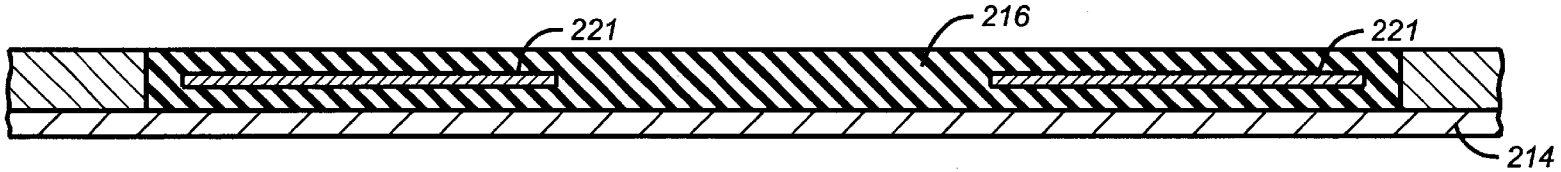
Figure 16:
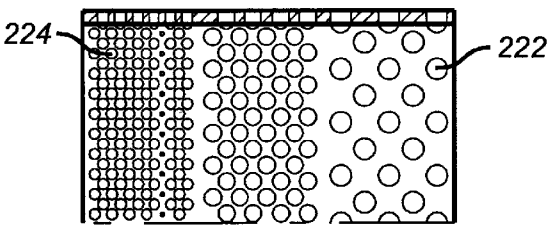
Figure 17:
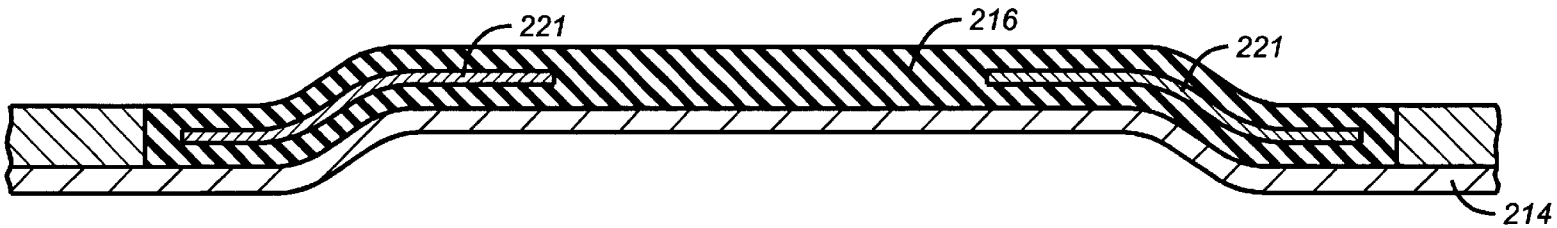
Figure 18:
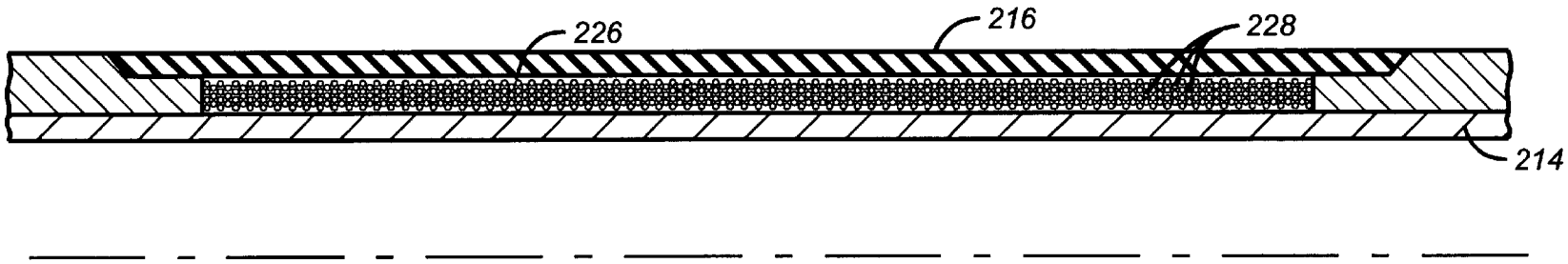
Figure 19:
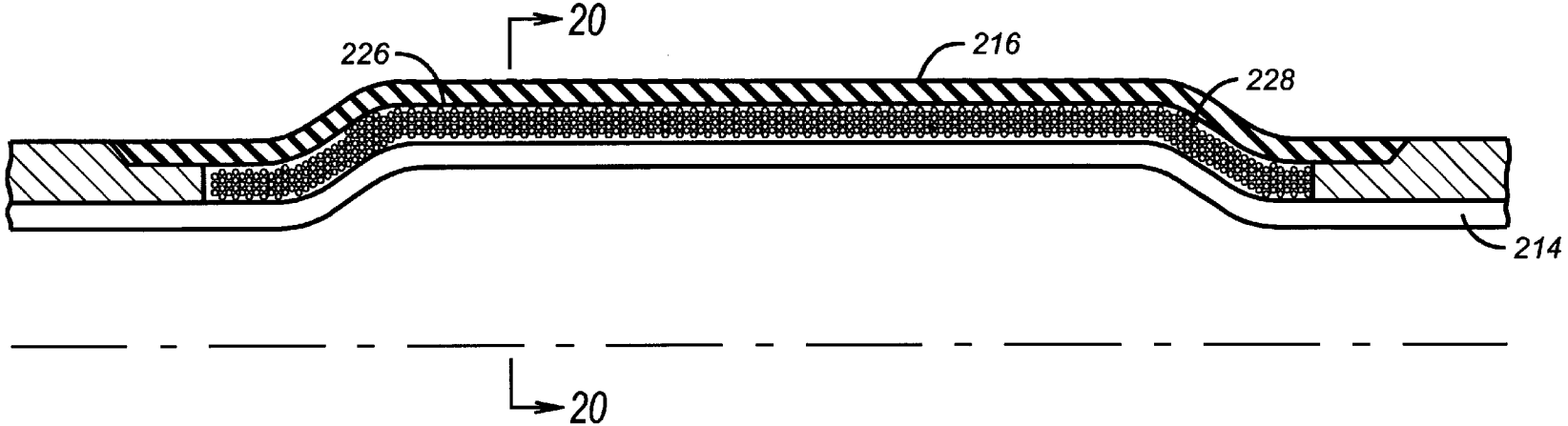
Figure 20:
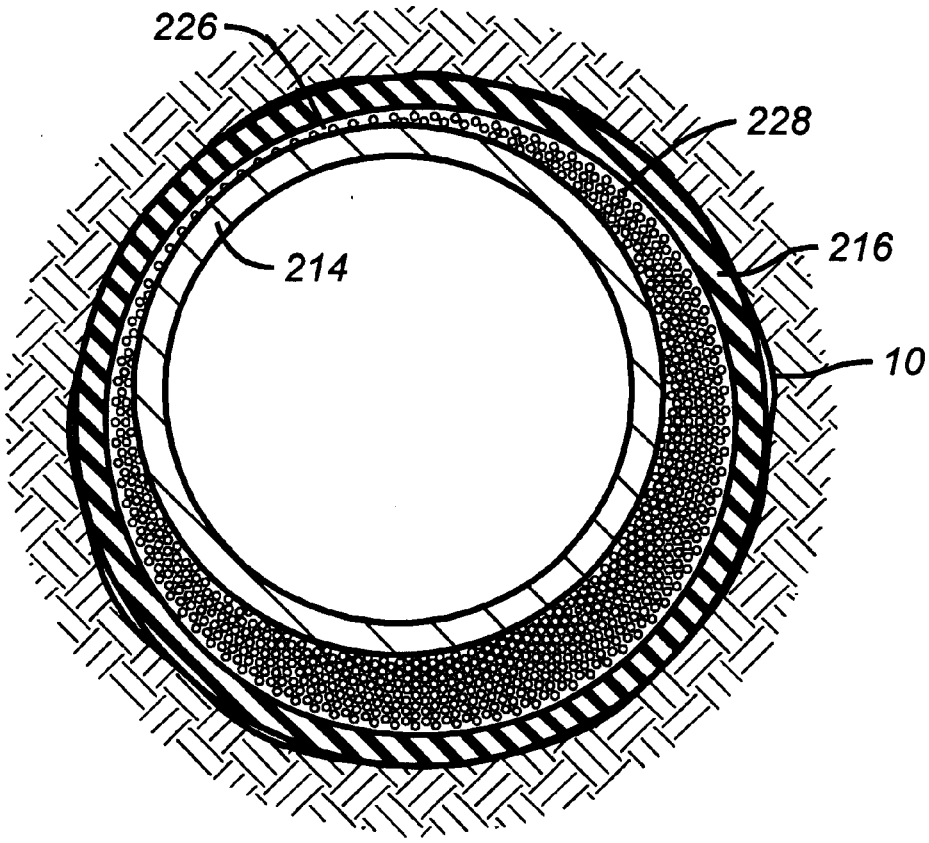
Figure 21:
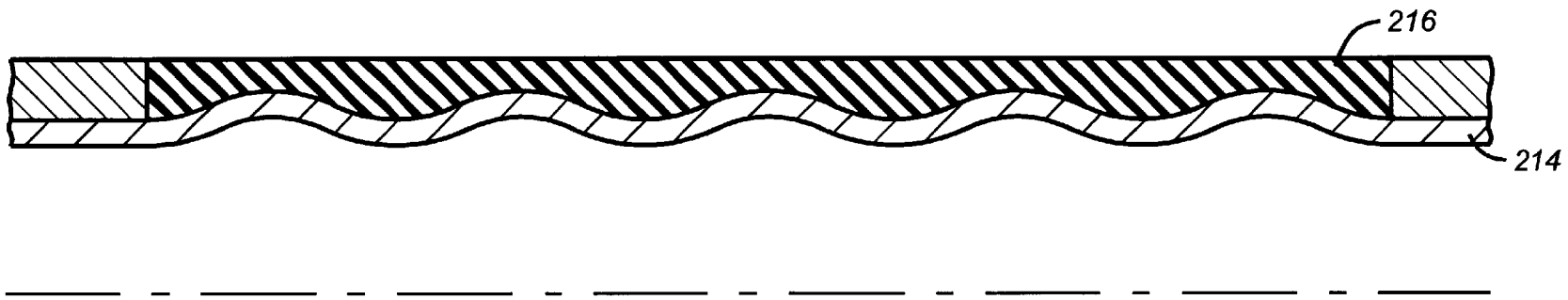
Figure 22:
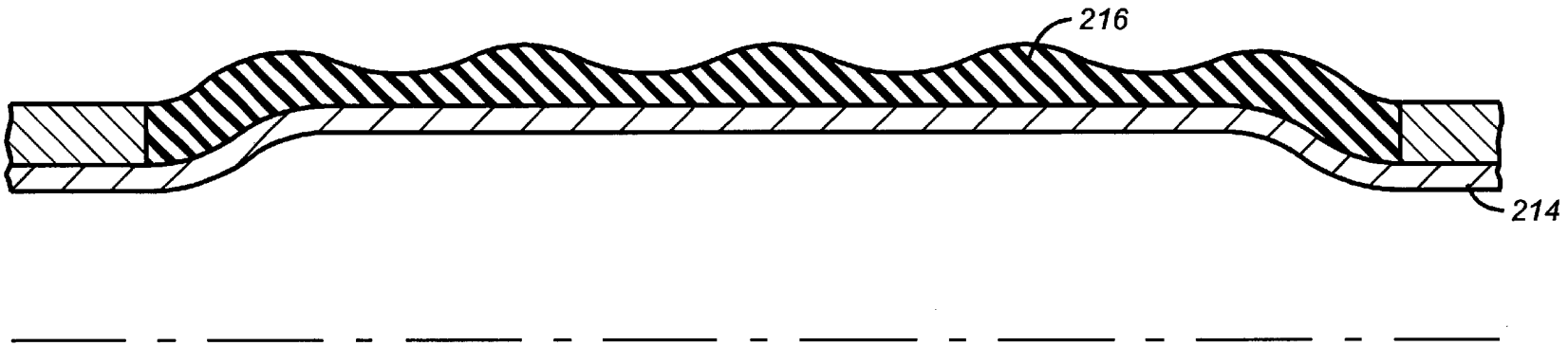
Figure 23:
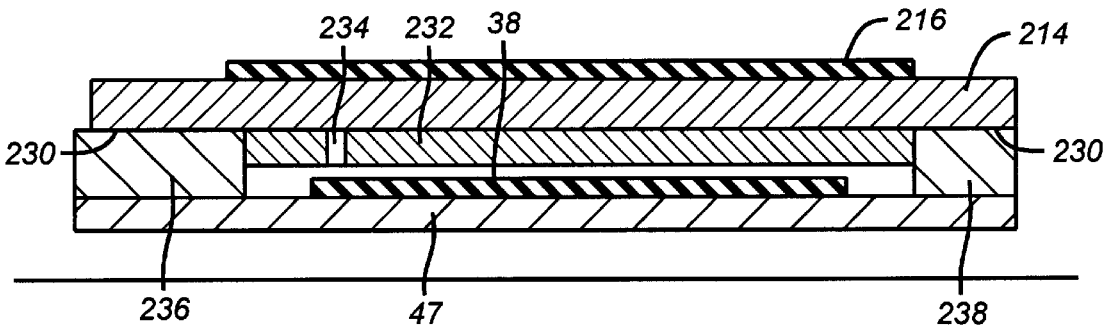
Figure 24:
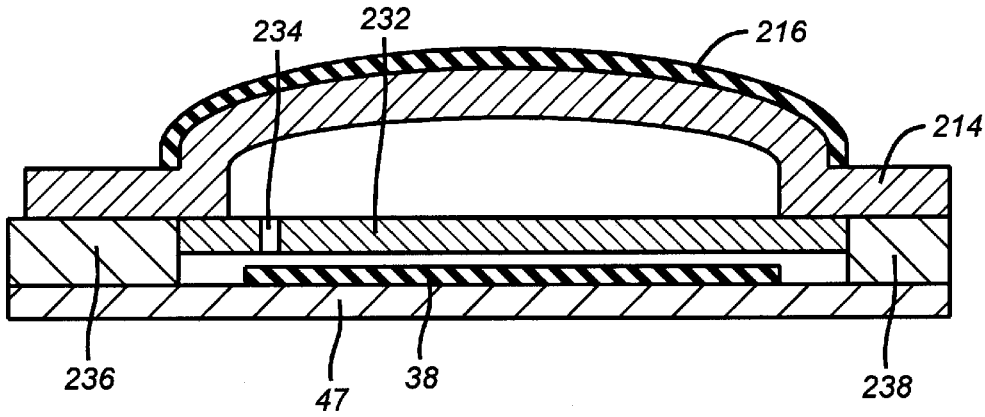
Figure 25:
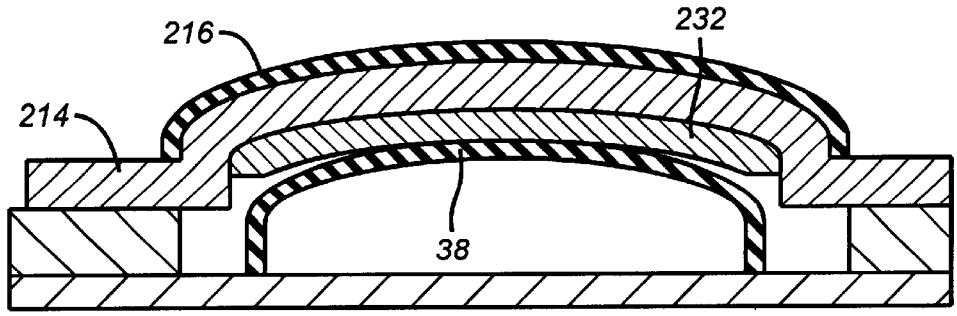

FIGS. 8*a–b* are a sectional elevation view of the injection control valve mounted below the circulating valve;

FIGS. 9*a–b* are a sectional elevation view of the inflatable expansion tool mounted below the injection control valve;

FIG. 10 is a sectional elevation view of the drain valve mounted below the inflatable expansion tool;

FIG. 11*a* detail of a first embodiment of the sealing element on an isolator in the run in position;

FIG. 12 is the view of FIG. 11 in the set position;

FIG. 13 is a second alternative isolator seal in the run in position;

FIG. 14 is the view of FIG. 13 in the set position;

FIG. 15 is a third alternative isolator seal in the run in position featuring end sleeves;

FIG. 16 is a detail of an end sleeve shown in FIG. 15;

FIG. 17 is the view of FIG. 15 in the set position;

FIG. 18 is a fourth alternative isolator seal showing a filled cavity beneath it, in the run in position;

FIG. 19 is the view of FIG. 18 in the set position;

FIG. 20 is the view taken along line 20—20 shown in FIG. 19;

FIG. 21 illustrates a sectional elevation view of an undulating seal on the isolator in the run in position;

FIG. 22 is the view of FIG. 21 in the set position;

FIG. 23 is another alternative isolator with a wall re-enforcing feature shown in section during run-in;

FIG. 24 is the view of FIG. 23 after the mandrel has been expanded;

FIG. 25 is the view of FIG. 24 after expansion of an insert sleeve with the bladder.

Figure 26:
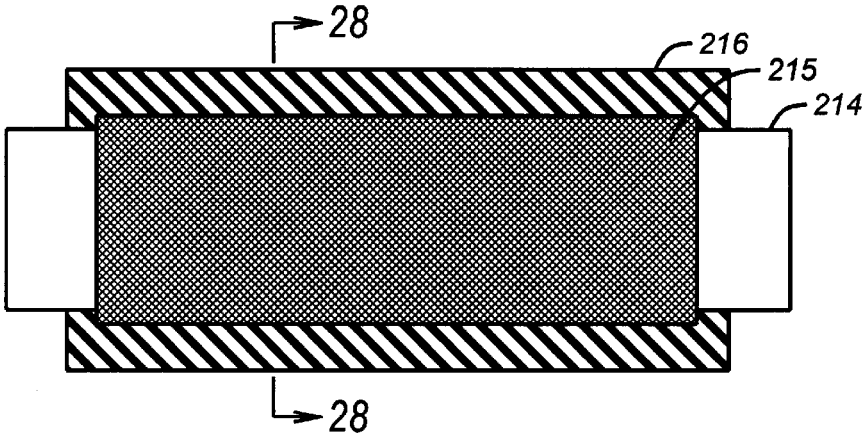
Figure 27:
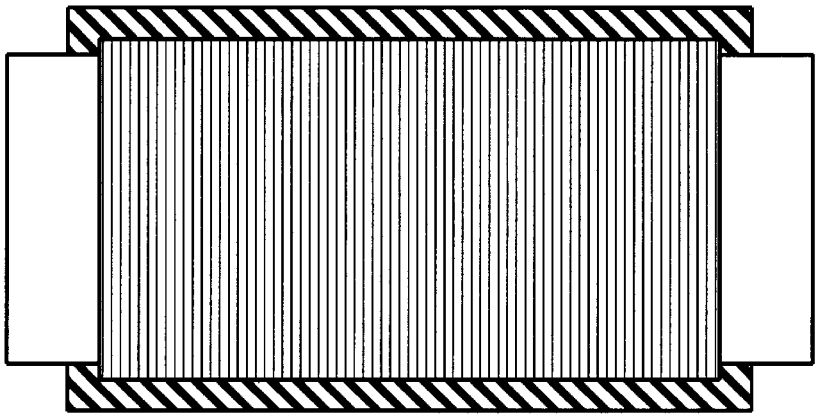
Figure 28:
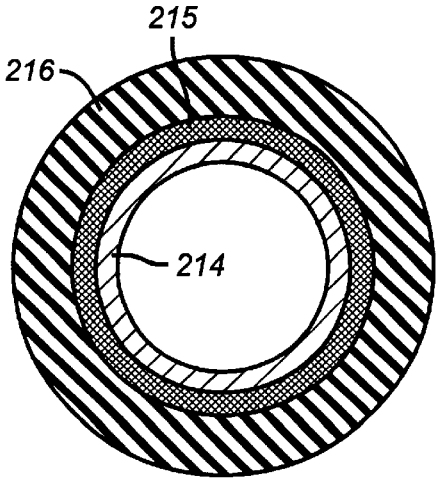

FIG. 26 is a section view of an unexpanded isolator showing travel limiting sleeve;

FIG. 27 is the view of FIG. 26 after maximum expansion of the isolator; and FIG. 28 is the view at line 28—28 of FIG. 26.

DETAILED DESCRIPTION OF THE PREFERRED EMBODIMENT

Figure 1A:
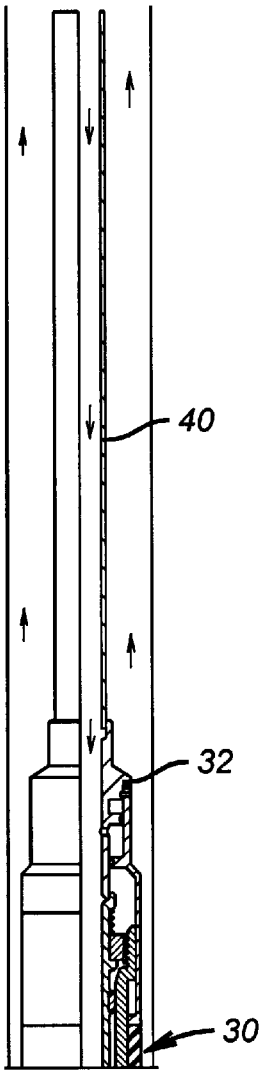
Figure 2A:
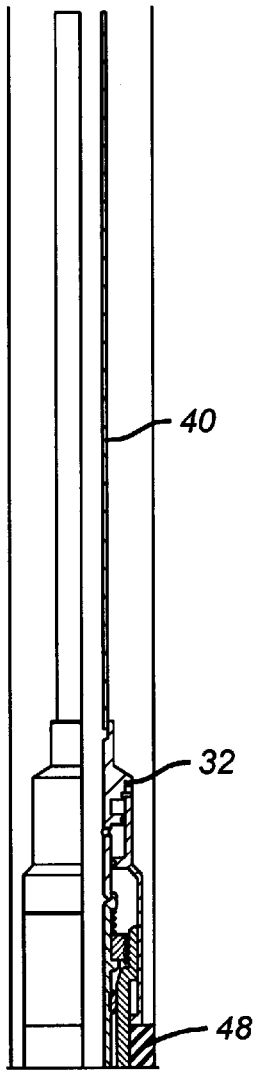
Figure 3A:
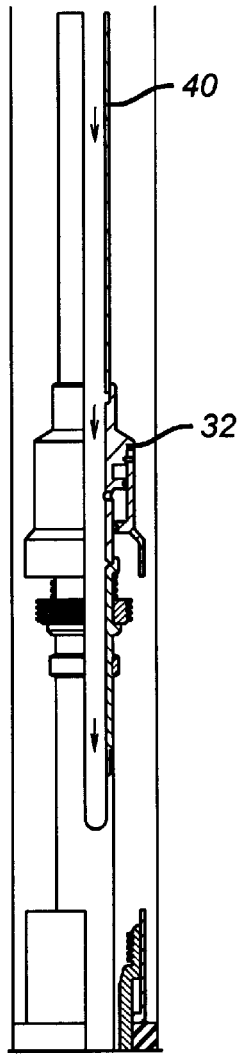

Referring to FIGS. 1*a–d*, the completion assembly C is illustrated in the run in position in well bore 10. At its lower end, as seen in FIGS. 1*d*–5*d* are a wash down shoe 12 and a seal sub 14 both of known design and purpose. Working up-hole from seal sub 14 are a pair of isolators 16 and 18 which are spaced apart to allow mounting a screen assembly 20 in between. Further up-hole is a section of tubular 22 whose length is determined by the spacing of the zones to be isolated in the well bore 10. Further up-hole is another set of isolators 24 and 26 having a screen assembly 28 in between. Optionally at the top of the completion assembly C is a packer 30, which is selectively settable against the well bore 10, as shown in FIG. 2*a*. Those skilled in the art will appreciate that the completion assembly described is for isolation of two distinct producing zones. The completion assembly C can also be configured for one zone or three or more zones by repeating the pattern of a pair of isolators above and below a screen for each zone.

The completion assembly C can be run in on an expansion assembly E. Located on the expansion assembly E is a setting tool 32 which supports the packer 30 and the balance of the completion assembly C for run in. Ultimately, the setting tool 32 actuates the packer 30 in a known manner. The majority of the expansion assembly E is nested within the completion assembly C for run in. At the lower end 34 of the expansion assembly E, there is engagement into a seal bore 36 located in seal sub 14. If this arrangement is used, circulation during run in is possible as indicated by the arrows shown in FIGS. 1*a–d*.

The expansion assembly E shown in FIGS. 1*a–d* through 5*a–d* is illustrated schematically featuring an expanding bladder 38. The bladder 38 is shown above the seal bore 36 in an embodiment where flow through the expansion assembly E can exit its lower end 34. In a known manner one or more balls can be dropped to land below the bladder 38 so that it can be selectively inflated and deflated at desired locations. While this is one way to actuate the bladder 38, the preferred technique is illustrated in FIGS. 6–10. Using the equipment shown in these Figures, the placement of the seal bore 36 will need to be above the bladder 38, as will be explained below.

At this point, the overall process can be readily understood. The completion assembly C is supported off of the expansion assembly E for running in to the well bore in tandem on rigid or coiled tubing 40. The setting tool 32 engages the packer 30 for support. Circulation is possible during run in as flow goes through the expansion assembly E and, in the preferred embodiment shown in FIG. 7, exits laterally through the inflation valve 42 at ports 44 which are disposed below a seal bore such as 36. It should be noted that the inflation valve 42 (see FIG. 7) is disposed above screen expansion tool 47 (see FIGS. 9*a–b*), which comprises the bladder 38. During run in, the bladder 38 is deflated and circulation out of ports 44 goes around deflated bladder 38 and out through wash down shoe 14, or an equivalent lower outlet, and back to the surface through annulus 46.

The packer 30 is set using the setting tool 32, in a known manner which puts a longitudinal compressive force on element 48 pushing it against the well bore 10, closing off annulus 46 (as shown in FIG. 2*a*). The use of packer 30 is optional and other devices can be used to initially secure the position of completion assembly C prior to expansion, without departing from the invention.

The expansion assembly is then actuated from the surface to inflate bladder 38 so as to diametrically expand the lowermost isolator 16, followed by screen 20, isolator 18, and, if present, isolator 24, followed by screen 28, and isolator 26. These items can be expanded from bottom to top as described or in a reverse order from top to bottom or in any other desired sequence without departing from the invention. The expansion technique involves selective inflation and deflation of bladder 38 followed by a repositioning of the expansion assembly E until all the desired zones are isolated by expansion of a pair of isolators above and below an expanded screen. The number of repositioning steps is dependent on the length of bladder 38 and the length and number of distinct isolation assemblies for the respective zones to be isolated.

Figure 3B:
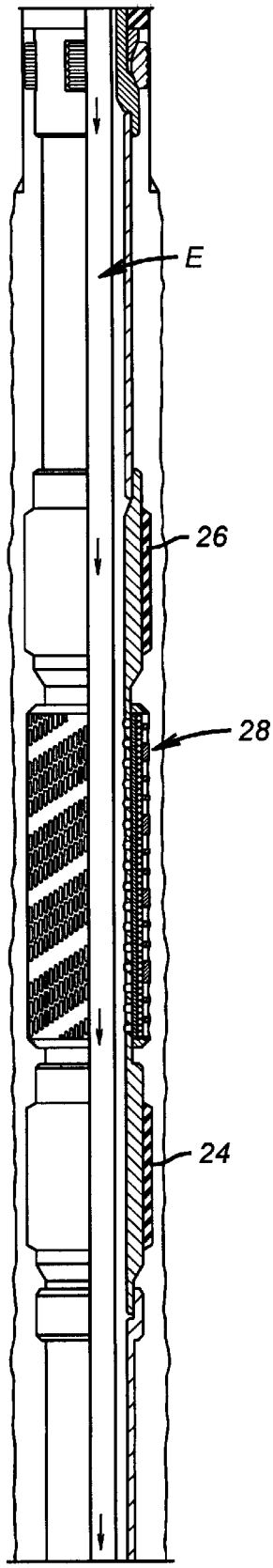
Figure 3C:
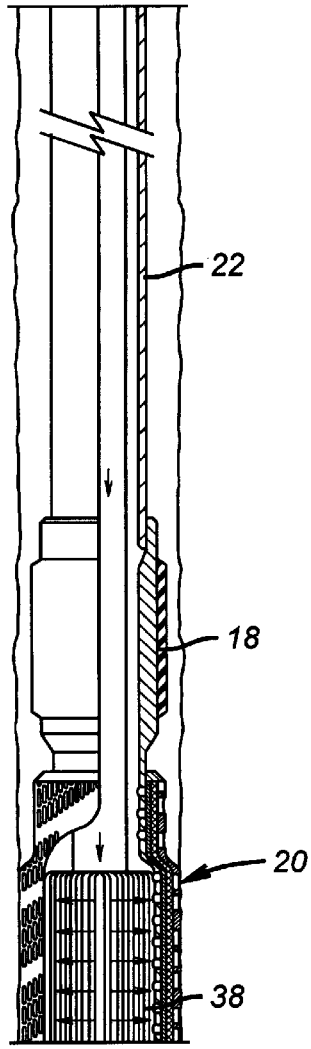
Figure 1D:
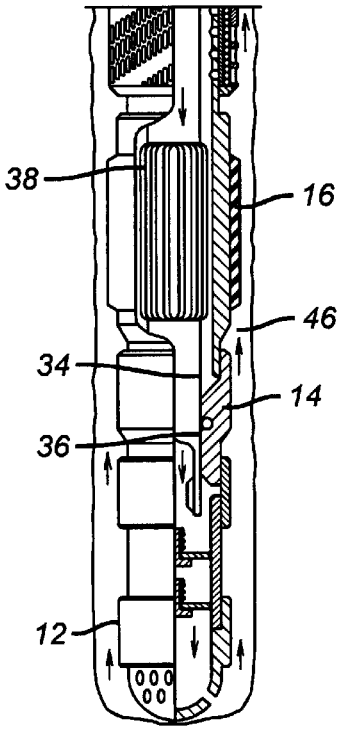
Figure 2D:
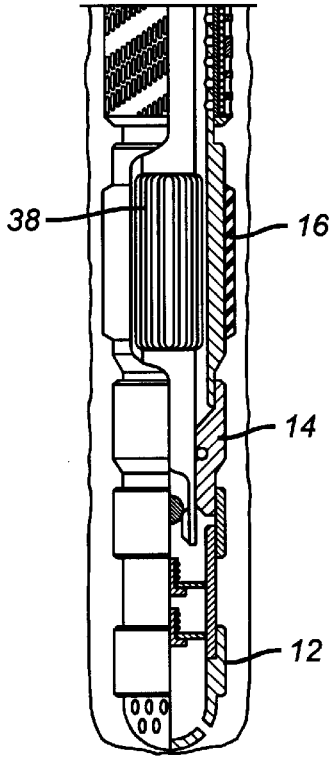
Figure 3D:
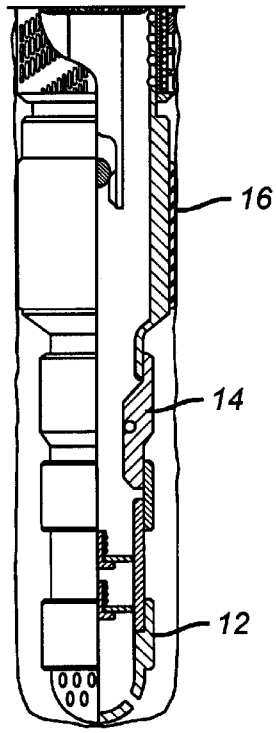
Figure 4A:
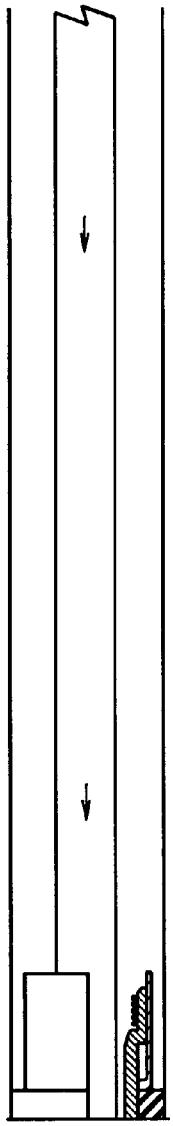
Figure 5A:
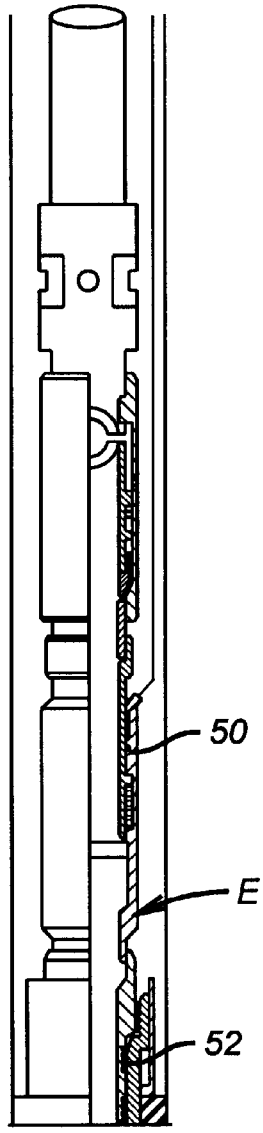
Figure 4B:
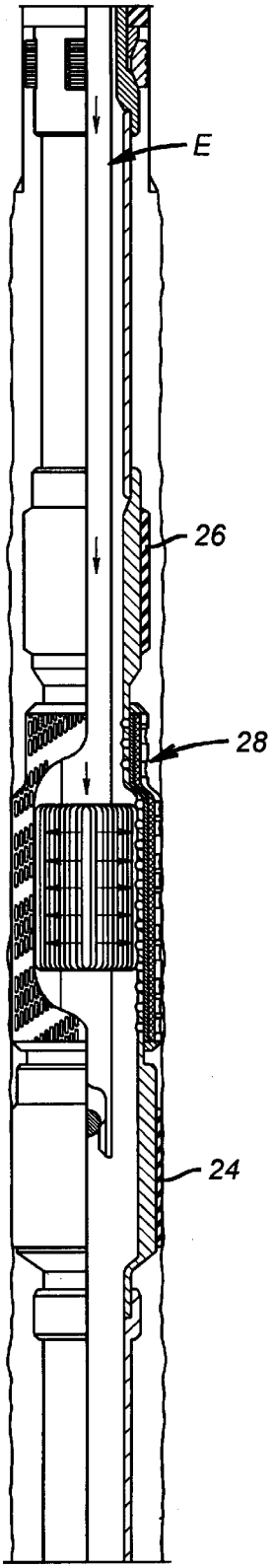
Figure 5B:
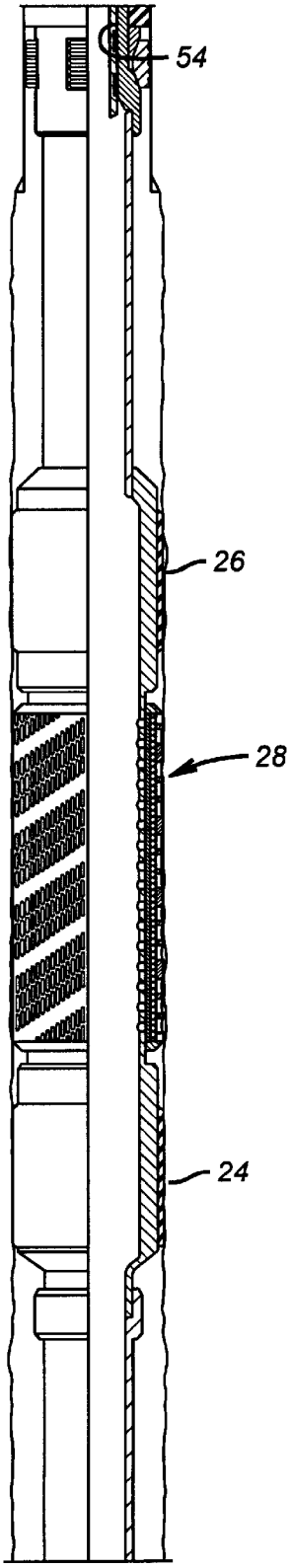
Figure 4C:
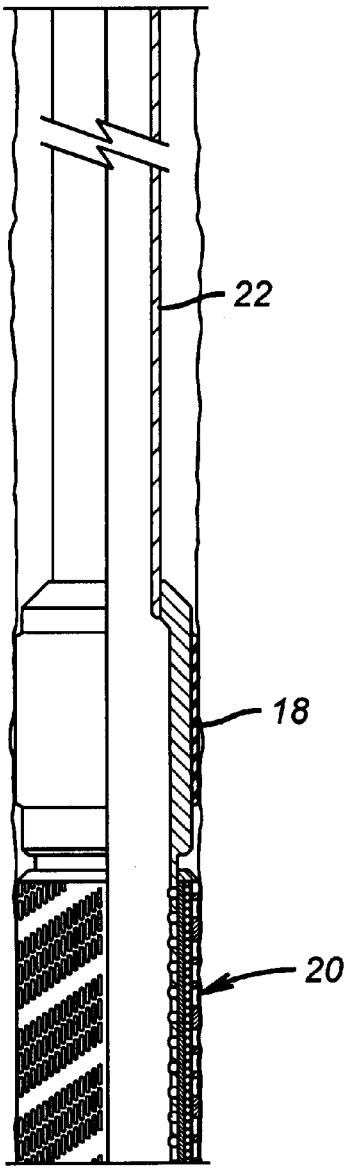
Figure 5C:
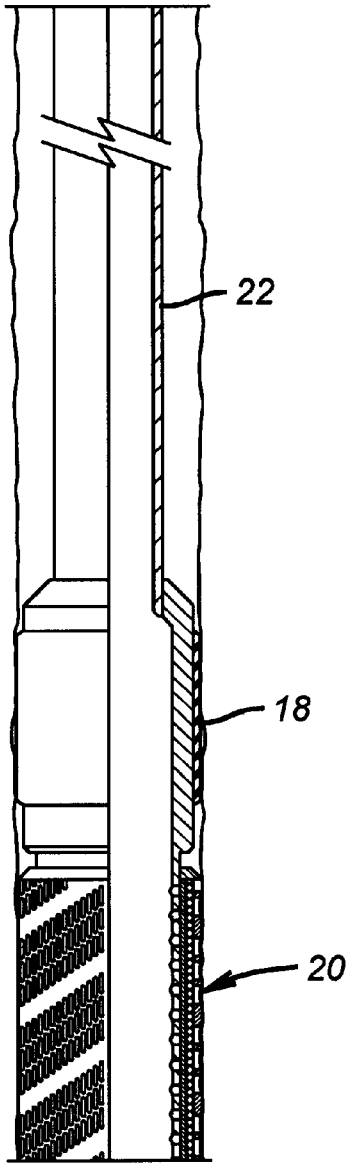
Figure 4D:
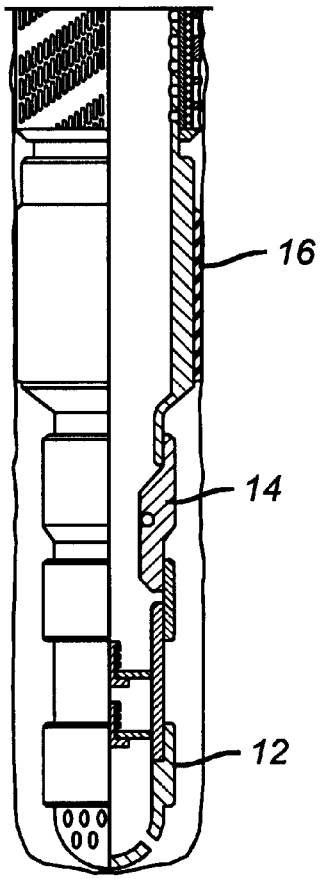
Figure 5D:
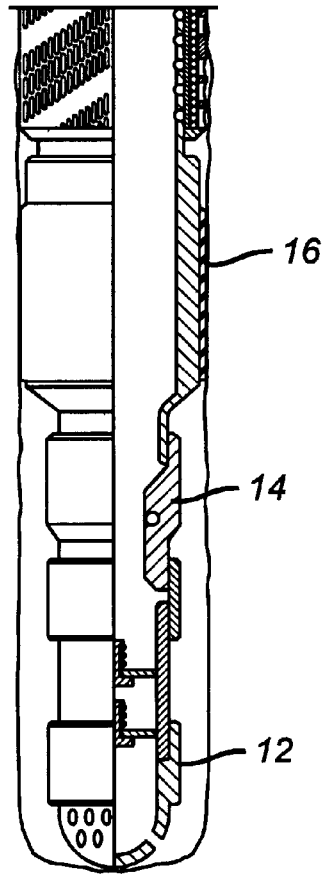
Figure 6:
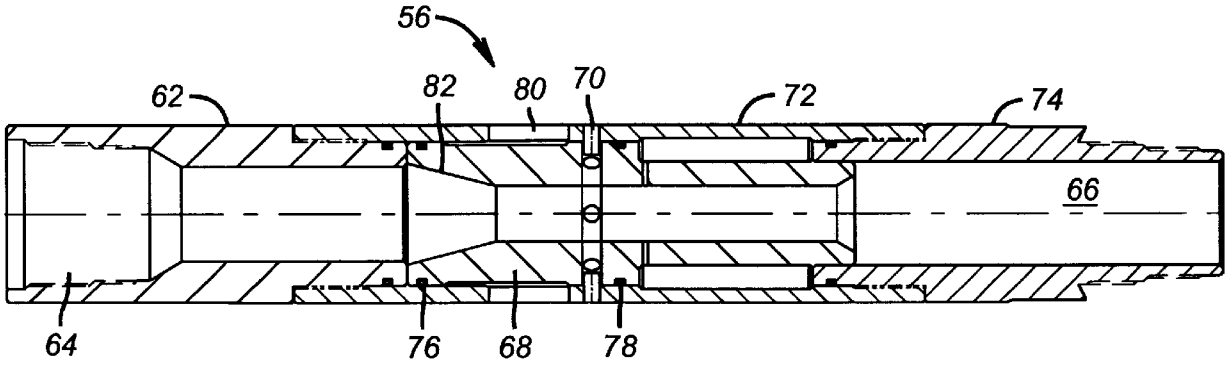
FIG. 6 is a sectional elevation view of the circulating valve of the expansion assembly.
Figure 7:
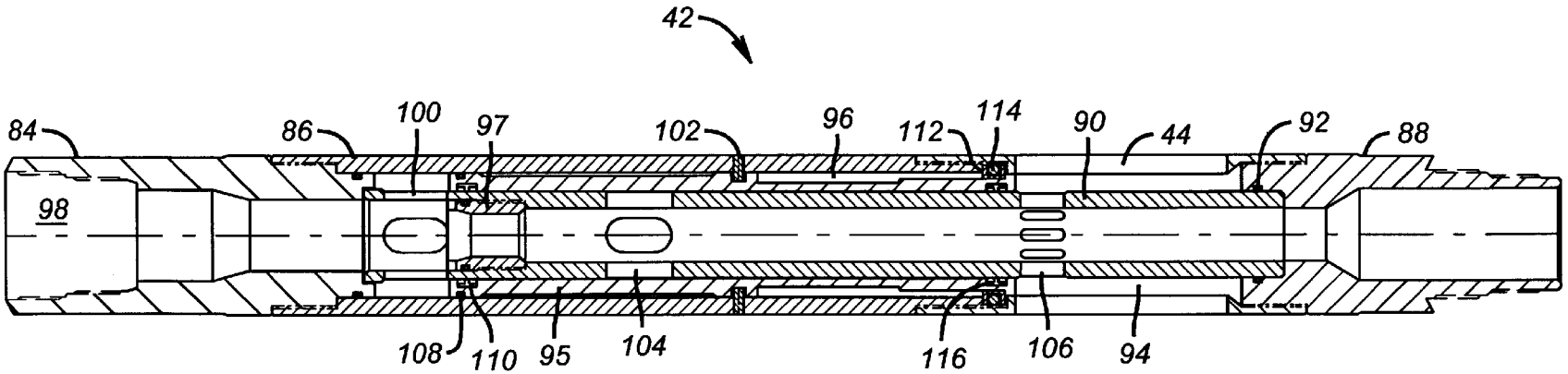
FIG. 7 is a sectional view elevation of the inflation valve mounted below the circulating valve.

FIG. 3*c* shows the lower screen 20 and the lowermost isolator 16 already expanded. FIG. 4*b* shows the upper screen 28 being expanded, while FIGS. 5*a–d* reveal the conclusion of expansion which results in isolation of two zones, or stated differently, two production locations in the well bore 10. This Figure also illustrates that the expansion assembly E has been removed and a production string 50 having lower end seals 52 has been tagged into seal bore 54 in packer 30. It should be noted that tubular 22 has not been expanded as it lies between the zones of interest that require isolation.

Now that the overall method has been described, the various components, which make up the preferred embodiment of the expansion assembly E, will be further explained with reference to FIGS. 6–10. Going from up-hole to down hole the expansion assembly E comprises: a circulating valve 56 (see FIG. 6); an inflation valve 42 (see FIG. 7); an injection control valve 58 (see FIGS. 8*a–b*); an inflatable expansion tool 47 (see FIGS. 9*a–b*); and a drain valve 60 (see FIG. 10).

The purpose of the circulating valve 56 is to serve as a fluid conduit during the expansion and deflation of the bladder 38. It comprises a top sub 62 having an inlet 64 leading to a through passage 66. A piston 68 is held in the position shown by one or more shear pins 70. Housing 72 connects a bottom sub 74 to the top sub 62. Seals 76 and 78 straddle opening 80 in housing 72 effectively isolating opening 80 from passage 66. A ball seat 82 is located on piston 68 to eventually catch a ball (not shown) to allow breaking of shear pins 70 and a shifting of piston 68 to expose opening or openings 80. The main purpose of the circulating valve 56 is to allow drainage of the string as the expansion assembly E is finally removed from the well bore 10 at the conclusion of all the required expansions. This avoids the need to lift a long fluid column that would otherwise be trapped inside the tubing 40, during the trip out of the hole.

The next item, mounted just below the circulating valve 56, is the inflation valve 42. It is illustrated in the run in position. It has a top sub 84 connected to a dog housing 86, which is in turn connected to a bottom sub 88. A body 90 is mounted between the top sub 84 and the bottom sub 88 with seal 92 disposed at the lower end of annular cavity 94. A piston 95, having a groove 96, is disposed in annular cavity 94. Body 90 supports ball seat 97 in passage 98. Body 90 has a lateral passage 100 to provide fluid communication between passage 98 and piston 95. A shear pin or pins 102 secure the initial position of piston 95 to dog housing 86. Body 90 also has lateral openings 104 and 106 while dog housing 86 has a lateral opening 44 near opening 106. At the top of piston 95 are seals 108 and 110 to allow for pressure buildup above piston 95 in passage 98 when a ball (not shown) is dropped onto ball seat 97. Mounted to dog housing 86 are locking dogs 112 which are biased into groove 96 when it presents itself opposite dogs 112. Biasing is provided by a band spring 114.

The operation of the inflation valve 42 can now be understood. During run in, passage 98 is open down to lateral opening 106. Since passage 98 is initially obstructed in injection control valve 58, for reasons to be later explained, flow into passage 98 exits the dog housing 86 through lateral openings 106 (in body 90) and lateral opening 44 (in dog housing 86). Since opening 44 is below a seal bore (such as 36) mounted to the completion assembly C flow from the surface will, on run in, go through the circulating valve 56 and through passage 98 of inflation valve 42 and finally exit at port 44 for conclusion of the circulation loop to the surface through annulus 46. Dropping a ball (not shown) onto ball seat 97 allows pressure to build on top of piston 95, which breaks shear pin 102 as piston 95 moves down. This downward movement allows flow to bypass the now obstructed ball seat 97 by moving seals 108 and 110 below lateral port 104. At the same time, lateral port 44 is obstructed as seal 116 passes port 106 in body 90. The movement of piston 95 is locked as dogs 112 are biased by band spring 114 into groove 96. Pressure from the surface, at this point, is directed into the injection control valve 58.

The injection control valve 58 comprises a top sub 118 connected to a valve mandrel 120 at thread 122. Valve mandrel 120 is connected to spring mandrel 124 at thread 126. Spring mandrel 124 is connected to sleeve adapter 128 at thread 130. Sleeve adapter 128 is connected to bottom sub 132 at thread 134. Wedged between valve mandrel 120 and top sub 118 are perforated sleeve 136 and plug 138. Seal 140 is used to seal plug 138 to valve mandrel 120. Flow entering passage 142 from passage 98 in the inflation valve 42 passes through openings 144 in perforated sleeve 136 and through lateral passage 146 in valve mandrel 120. This happens because plug 138 obstructs passage 142 below openings 144. Piston 148 fits over valve mandrel 120 to define an annular passage 150, the bottom of which is defined by seal adapter 152, which supports spaced seals 154 and 156. In the initial position, seals 154 and 156 straddle passage 158 in valve mandrel 120. A pressure buildup in annular passage 150 displaces piston 148 and moves seal 154 past passage 158 to allow flow to bypass plug 138 through a flow path which includes openings 144, passage 146, passage 158, and eventually out bottom sub 132. At the same time spring 160 is compressed by seal adapter 152, which moves in tandem with piston 148. Seals 154 and 156 wind up straddling passage 162 in valve mandrel 120. This prevents escape of fluid out through passage 164 in seal adapter 152. Accordingly, fluid flow initiated from the surface will flow through injection control valve 58 after sufficient pressure has displaced piston 148. Such flow will proceed into inflatable expansion tool 47. Upon removal of surface pressure, spring 160 displaces seals 154 and 156 back above passage 162 to allow pressure to be bled off through passage 164 to allow bladder 38 to deflate, as will be explained below.

Referring now to FIGS. 9*a–b*, the structure and operation of the inflatable expansion tool 47 will now be described. A top sub 168 is connected to a mandrel 170 and a bottom sub 172 is connected to the lower end of the mandrel 170. Bladder 38 is retained in a known manner to mandrel 170 by a fixed connection at seal adapter 174 at its upper end and by a movable seal adapter 176 at its lower end. Seal adapter 176 is connected to spring housing 178 to define a variable volume chamber 180 in which are mounted a plurality of Belleville washers 182. A stop ring 184 is mounted to mandrel 170 in a manner where it is prevented from moving up-hole. Passages 186 and 187 communicate pressure in central passage 188 through the mandrel 170 and under bladder 38 to inflate it. In response to pressure below the bladder 38, there is up-hole longitudinal movement of seal adapter 176 and spring housing 178. Since stop ring 184 can't move in this direction, the Belleville washers get compressed. Outward expansion of bladder 38 can be stopped when all the Belleville washers have been pressed flat. Other techniques for limiting the expansion of bladder 38 will be described below. What remains to be described is the drain valve 60 shown in FIG. 10. It is this valve that creates the back-pressure to allow bladder 38 to expand.

The drain valve 60 has a top sub 190 connected to an adapter 192, which is, in turn, connected to housing 194 followed, by a bottom sub 196. A piston 198 is connected to a restrictor housing 200 followed by a seal ring seat 202. Restrictor housing 200 supports a restrictor 204. Spring 206 bears on bottom sub 196 and exerts an up-hole force on piston 198. Seal 208 forces flow through restrictor 204 producing back-pressure, which drives the expansion of bladder 38. Initially flow will proceed through restrictor 204 into passage 210 and around spring 206 and between seal ring seat 202 and seal ring insert 212. This flow situation will only continue until there is contact between seal ring seat 202 and seal ring insert 212. At that time flow from the surface stops and applied pressure from surface pumps is applied directly under bladder 38. One reason to cut the flow from drain valve 60 is to prevent pressure pumping into the formation below, which can have a negative affect on subsequent production. When the surface pumps are turned off, a gap reopens between seal ring seat 202 and seal ring insert 212. Some under bladder pressure can be relieved through this gap. Most of the accumulated pressure will bleed off through passage 164 in the injection control valve 58 (see FIG. 8*a*) in the manner previously described.

Those skilled in the art can now see how by selective inflation and deflation of bladder 38 the isolators and screens illustrated in FIGS. 1*a–d* can be expanded in any desired order.

Some of the features of the invention are the various designs for the expandable isolator, such as isolator 26, as illustrated in FIGS. 11–22. It should be noted that the isolator depicted in FIGS. 1*a–d* is not an inflatable packer in the traditional sense. Rather it is a tubular mandrel 214 surrounded by a sealing sleeve 216 wherein inflatable, such as bladder 38, or other devices are used to expand both mandrel 214 and sleeve 216 together into the open hole of well bore 10.

In the embodiments shown in FIGS. 11 and 12 the sleeve 216 is shown in rubber. There are circumferential ribs 218 added to prevent rubber migration or extrusion upon expansion. The expanded view is illustrated in FIG. 12. In open hole completions, the ribs 218 dig into the borehole wall. This assures seal integrity against extrusion. Ribs 218 can be directly attached to the mandrel 214 or they can be part of a sleeve, which is slipped over mandrel 214 before the rubber is applied. Direct connection of ribs 218 can cause locations of high stress concentration, whereas a sleeve with ribs 218 mounted to it reduces the stress concentration effect. Ribs 218 can be applied in a variety of patterns such as offset spirals. They can be continuous or discontinuous and they can have variable or constant cross-sectional shapes and sizes.

A beneficial aspect of ribs 39 in bladder 38 (see FIG. 9*a*) is that their presence helps to reduce longitudinal shortening of mandrel 214 and sleeve 216 as they are diametrically expanded. Limiting longitudinal shrinkage due to expansion is a significant issue when expanding long segments because a potential for a misalignment of the screen and surrounding isolators from the zone of interest. This effect can happen if there is significant longitudinal shrinkage, which is a more likely occurrence if there is a mechanical expansion with a cone.

The expansion techniques can be a combination of an inflatable for the isolators and a cone for expansion of screens. This hybrid technique is most useful for cone expanding long screen sections while the isolators above and below are expanded with a bladder. The isolators require a great deal of force to assure seal integrity making the application of inflatable technology most appropriate. The inflation pressure for a bladder 38 disposed inside an isolator can be monitored at the surface. The characteristic pressure curve rises steeply until the mandrel starts to yield, and then levels off during the expansion process, and thereafter there is a subsequent spike at the point of contact with the formation or casing. It is not unusual to see the plateau at about 6,000 PSI with a spike going as high as 8500 PSI. Use of pressure intensifiers adjacent the bladder 38, as a part of the expansion assembly E, allows the up-hole equipment to operate at lower pressures to keep down equipment costs. The ability to monitor and control inflation pressure can be a control technique to regulate the amount of expansion in an effort to avoid mandrel failure or overstressing the formation. Another monitoring technique for real time expansion is to put strain sensors in the isolator mandrels and use known signal transmission techniques to communicate such information to the surface in real time. Yet another technique for limitation of expansion can be control of the volume of incompressible fluid delivered under the bladder 38. Another technique can be to apply longitudinal corrugations to the mandrel 214, such that the size it will expand to when rounded by an inflatable is known.

Referring now to FIGS. 13 and 14, another approach to limiting extrusion of sealing sleeve 216 upon expansion by a bladder 38, is to put reinforcing ribs 220 in whole or in part at or near the upper and/or lower ends of the sealing sleeve 216. Their presence creates an increased force into the open hole to reduce end extrusion, as shown in FIG. 14.

In FIGS. 15–17, the anti-extrusion feature is a pair of embedded rings 221 that run longitudinally in sleeve 216. The stiffness of each ring 221 can be varied along its length, from strongest at the ends of sleeve 216 to weaker toward its middle. One way to do this is to add bigger holes 222 closer to the middle of sleeve 216 and smaller holes 224 nearer the ends, as shown in FIG. 16. Another way is to vary the thickness.

In FIGS. 18–20, another variation is shown which involves a void space 226 between the mandrel 214 and the sleeve 216. This space can be filled with a deformable material, or a particulate material, such as proppant, sand, glass balls or ceramic beads 228. The beneficial features of this design can be seen after there is expansion in an out of round open hole, as shown in FIG. 20. Where there is a short distance to expand to the nearby borehole wall, contact of sleeve 216 occurs sooner. This causes a displacement of the filler 228 so that the regions with greater borehole voids can still be as tightly sealed as the regions where contact is first made. This configuration, in particular, as well as the other designs for isolators discussed above offers an advantage over mechanical expansion with a cone. Cone expansion applies a uniform circumferential expansion force regardless of the shape of the borehole. The inflate technique conforms the applied force to where the resistance appears. Expansions that more closely conform to the contour of the well bore can thus be accomplished. Use of the void 226 with filler 228 merely amplifies this inherent advantage of expansion with a bladder 38. Those skilled in the art will appreciate that the shorter the bladder 38, the greater is the ability of the isolator to be expanded in close conformity with the borehole configuration. One the other hand, a shorter bladder also requires more cycles for expansion of a given length of isolator or screen. Longer bladders not only make the expansion go faster, but also allow for greater control of longitudinal shrinkage. Here again, the ability to control longitudinal shrinkage will have a tradeoff. If the mandrel 214 is restrained from shrinking as much longitudinally its wall thickness will decrease on diametric expansion. Compensation for this phenomenon by merely increasing the initial wall thickness of the mandrel 214 creates the problem of greatly increasing the required expansion pressure.

A solution is demonstrated in FIGS. 23–25. In these Figures, the mandrel 214 still has the sleeve 216. Internally to mandrel 214 is a seal bore 230, which can span the length of the sleeve 216. Within the seal bore 230, the inflatable expansion tool 47 is inserted. The inflatable expansion tool 47 has been modified to have a bladder 38 and an insert sleeve 232 with a port 234 all mounted between two body rings 236 and 238. Initially, as shown in FIG. 24, fluid pressure expands the mandrel 214 against the borehole through port 234. Then the bladder 38 is expanded to push the sleeve 232 against the already expanded mandrel 214 (see FIG. 25).

Yet another technique for improving the sealing of an isolator is to take advantage of the greater coefficient of thermal expansion in the sleeve 216 such as when it is made of rubber. If the rubber is pre-cooled prior to running into the well bore it will grow in size as it comes to equilibrium temperature even after it has been inflatably expanded. The subsequent expansion increases sealing load. Thus rather than over-expanding the formation in-order to store elastic energy in it, the use of a mandrel 214 with a thin rubber sleeve 216 allows storage of elastic strain in the rubber itself. Although rubber has been mentioned for sleeve 216 other resilient materials compatible with down hole temperatures, pressures and fluids can be used without departing from the invention.

Figure 1B:
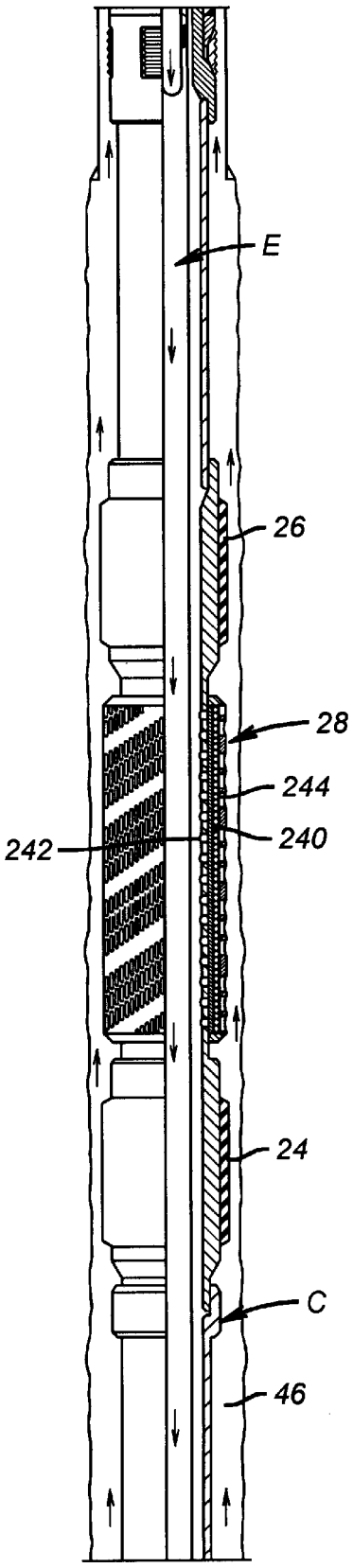
Figure 2B:
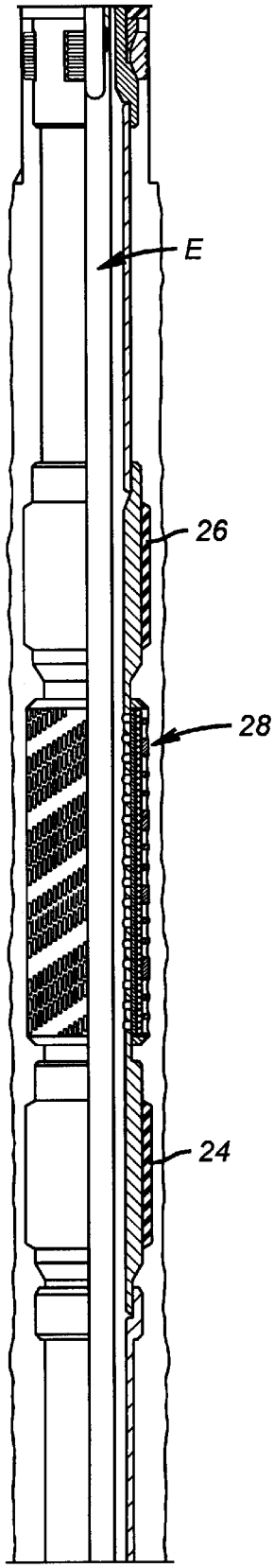
Figure 1C:
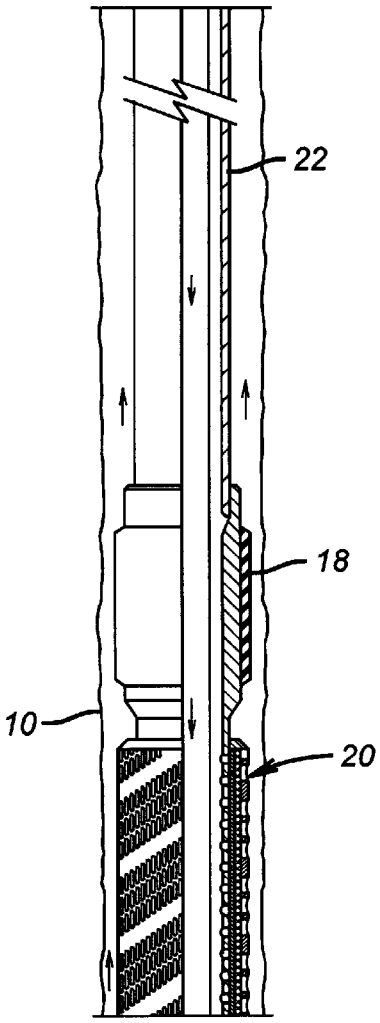
Figure 2C:
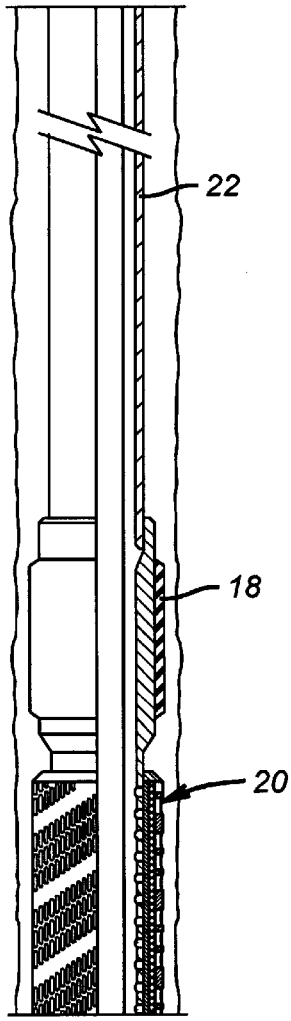

The screens, such as 28 can have a variety of structures and can be a single or multi-layer arrangement. In FIG. 1*b*, the screen 28 is shown as a sandwich of a 250-micron membrane 240 between inner 242 and outer 244 jackets. These jackets are perforated or punched and the membrane itself can be a plurality of layers joined to each other by sintering or other joining techniques. The advantage of the sandwich is to minimize relative expansion as well as to protect the membrane 240.

Yet another isolator configuration is visible in FIGS. 21–22. Here the mandrel 214 has a wavy configuration one embodiment of which is a circumferential ribbed appearance. The sleeve 216 is applied to have a cylindrical exterior surface. After expansion, as seen in FIG. 22, the mandrel 214 becomes cylindrically shaped while the sleeve takes on a wavy exterior shape with peaks where the mandrel 214 had valleys, in its pre-expanded state.

Yet another issue resolved by the present invention is how to limit expansion of the isolators in a radial direction. Unrestrained growth can result in rupture if the elongation limits of the mandrel 214 are exceeded. Additionally, excessive loads on the formation can fracture it excessively adjacent the isolator. Expansion limiting devices can be applied to the isolator itself or to the fluid expansion tool used to increase its diameter. In one example, the mandrel 214 is wrapped in a sleeve 215 made of a biaxial metal weave before the rubber is applied. This material is frequently used as an outer jacket for high-pressure industrial hose. It allows a limited amount of diametric expansion until the weave "locks up" at which time further expansion is severely limited in the absence of a dramatic increase in applied force. This condition can be monitored from the surface so as to avoid over-expansion of the isolator.

As an expanding-mandrel packer is radially expanded outwards it is desirable to have a mechanism in place to limit the radial growth of the packer. If the packer is allowed to expand without restraint of some kind it will ultimately rupture once the elongation limit of the mandrel material is exceeded. Also, if the packer is allowed to place an excessive load against an open hole formation wall the formation may be damaged and caused to fracture adjacent to the packer. There needs to be an expansion limiting mechanism in either the packer, such as isolator 16, or expansion device, such as expansion assembly E.

If the expanding-mandrel packer is being expanded using an inflatable packer (i.e. using hydraulic pressure), once the yield point of the material is exceeded and the mandrel deforms plastically, pressure indications of the amount of radial expansion is impossible. Therefore, it is desirable that once a pre-determined level of expansion is obtained there is a pressure indication that would indicate the packer is at its maximum design limit. An increase in applied pressure would be obtained if at some point the packer is subjected to an increased mechanical force opposing additional expansion.

The expansion of the packer may be limited by wrapping a bi-axial metal weave sleeve over the mandrel (see FIG. 26) prior to adding the sealing medium 216 (i.e. rubber). The bi-axial sleeve 215 will grow circumferentially as the packer mandrel is expanded, however at a pre-determined diameter the bi-axial sleeve will "lock-up" (see FIG. 27), preventing any additional radial expansion of the mandrel without a significant increase in applied radial load from the expansion device. This could give an indication at the surface that the limiting diameter of the packer has been reached, and further expansion is ceased.

The bi-axial mesh sleeve 215 would be fabricated in a tubular shape, and would be installed over the expanding-mandrel 214 during assembly of the packer. The mesh sleeve 215 would be in the un-expanded condition at this time. A rubber sealing cover 216 would then be applied over the bi-axial sleeve 215 to serve as the sealing component as the packer is expanded radially against the open-hole or casing. The assembled packer cross section is shown in FIG. 28.

As the packer is expanded in the borehole, the bi-axial mesh sleeve 215 expands circumferentially along with the packer mandrel 214. The rubber cover 216 is also expanding at this time. Once a pre-determined amount of expansion is obtained however the weaved metal fibers in the bi-axial sleeve will reach a configuration where further expansion is not possible, without breaking the fibers in the mesh. This will result in additional resistance to radial expansion, which will be detected by an increase in applied pressure required for additional expansion. At this point attempts at further expansion is ceased.

FIG. 27 shows the condition of the packer after reaching the expansion limit of the packer, as dictated by the maximum diametrical growth limit of the bi-axial mesh sleeve 215. The fiber orientation in the mesh sleeve is more in a perpendicular orientation to the long axis of the packer than before expansion was started. The amount of expansion possible in these mesh sleeves is dictated by the wrapping pattern used, and can be varied to allow various expansion potentials.

The amount of expansion of bladder 38 can also be limited by regulation of volume delivered to it by measuring the flow going in or by delivering fluid from a reservoir having a known volume. Typically the isolators and screens of the present invention will have to be expanded up to 25%, or more, to reach the borehole. This requires materials with superior ductility and toughness. Some acceptable materials are austenitic stainless steels, such as 304L or 316L, super austenitic stainless steel (Alloy 28), and nickel based alloys (Inconel 825). As much as a 45% elongation can be achieved by using these materials in their fully annealed state. These materials have superior corrosion resistance particularly in chlorides or in sour gas service, although some of the materials perform better than others. Inconel 825 is very expensive which may rule it out for long intervals. In vertical wells with short zones this cost will not normally be an issue.

The sequence of expansion can also have an effect on the overall system performance of the isolators. A desirable sequence can begin with an upper isolator followed by a screen expansion followed by expansion of the lower isolator. Simultaneous expansion of the isolators and screen should be avoided because of the potentially different pressure responses, which, in turn, can cause either under or over expansion of the isolators, which, in turn, can cause inadequate sealing or formation fracturing.

When an isolator, such as 16, is expanded, the sealing integrity can be checked. This can be accomplished using the expansion assembly E illustrated in FIGS. 6–10. After expansion of the bladder 38, which sets isolator 16, the bladder 38 is allowed to deflate by removal of pressure from the surface. Thereafter, flow from the surface is resumed with bladder 38 still in position inside the now expanded isolator 16. The injection control valve 58 is opened by flow through it, which ultimately exits through the drain valve 60. Due to creation of backpressure by virtue of restrictor 204 (see FIG. 10) the bladder re-inflates inside the expanded mandrel 214 of the isolator 16. A seal is created between the completion assembly C and the expansion assembly E. Since there is an exit point at wash down shoe 14 and the isolator 16 is already expanded against the well bore 10, applied pressure from the surface will go back up the annulus 46 until it encounters the sealing sleeve 216, which is now firmly engaging the bore hole wall 10. The annulus 46 is monitored at the surface to see if any returns arrive. Absence of returns indicates the seal of isolator 16 is holding. It should be noted that conducting this test puts pressure on the formation for a brief period. It should also be noted that the other isolators could be checked for leakage in a similar manner. For example, isolator 18 can be checked with bladder 38 re-inflated and flow through the expansion assembly E, which exits through screen 20 and exerts pressure against a sealing sleeve 216 of isolator 18.

As previously mentioned, it may be desirable to combine the inflatable technique with a mechanical expansion technique using a cone expander. The driven cone technique may turn out to be more useful in expanding the screen, since substantially less force is required. Cone expansion is a continuous process and can be accomplished much faster for the screens, which are typically considerably longer than the isolators. When it comes to the isolators, the cone expansion technique has some serious drawbacks. Since the isolators must be expanded in open hole or casing in order to obtain a seal with a force substantial enough for sealing, greater certainty is required that such a seal has been accomplished than can be afforded with cone expansion techniques. In open hole applications, the exact diameter of the hole is unknown due to washouts, drill pipe wear of the borehole, and other reasons. In cased hole applications, there is the issue of manufacturing tolerances in the casing. If the casing is slightly oversized, there will be insufficient sealing using a cone of a fixed dimension. There may be contact by the sealing sleeve 216 but with insufficient force to hold back the expected differential pressures. On the other hand, if the casing is undersized, the isolator may provide an adequate seal but the amount of realized expansion may be too small to allow the cone driver to pass through. If driving from bottom to top there will be a solid lockup, which prevents removal of the cone driver from the well. If driving from top to bottom the isolator will not be able to expand over its entire length. A solution can be the use of the expansion assembly E for the isolator expansion in combination with a cone expansion assembly for the screens. These two expansion assemblies can be run in separate trips or can be combined together in a single assembly, which preferably is run into the borehole together with the completion assembly C.

It is known that drilling fluids can cause a drilling-induced damage zone immediately around the well bore 10. Depending on factors such as formation mechanical properties and residual stresses radial fractures can be extended as much as two feet into the formation to bypass the drilling-induced damage zone. This can be accomplished by over expanding the screens as they contact the well bore. A stable fracture presents little or no danger of migration into the zone sealed by the packers. Thus, for example in an eight inch well bore an expansion pressure of about 2500 PSI yields a fracture radius of about 0.5 feet, while a pressure of 7600 PSI causes a 1 foot radius fracture. Because of the large friction existing between the screen and the well bore wall, multiple radial fractures may be induced in different directions, not necessarily aligned with the maximum horizontal stress direction. Increased fracture density improves well bore productivity.

Those skilled in the art will appreciate that the techniques described above can result in a savings in time and expense in the order of 75% when compared to traditional techniques of cementing and perforating casing coupled with traditional gravel packing operations. The system is versatile and can be accomplished while running coiled tubing because the expansion technique is not dependent on work string manipulation as may by needed for a cone expansion using pushing or pulling on the work string. Expansion techniques can be combined and can include roller expansion as well as cone or an inflatable or combinations. The expansion assembly E can expand both the isolators and the screens. Another expansion device that can be used is a swedge. The preferred direction of expansion is down hole starting from the packer 30 or any other sealing or anchoring device, which can be used in its place. The inflatable technique acts to limit axial contraction when compared to other methods of expansion due to the axial contact constraint between the inflatable and isolator or screen during the expansion process. The sealing sleeve 216 can be rubber or other materials that are compatible with conditions down hole and exhibit the requisite resiliency to provide an effective seal at each isolator. The formulation of the sleeve can vary along its length or in a radial direction in an effort to obtain the requisite internal pressure for sealing while at the same time limiting extrusion. Real time feedback can be incorporated into the expansion procedure to insure sufficient expansion force and to prevent over-stressing. Stress can be sensed during expansion and reported to the surface as the bladder 38 expands. The delivered volume to the bladder 38 can be controlled or the flow into it can be measured. The formation can be locally fractured by screen expansion to compensate for drilling fluid, which can contaminate the borehole wall. Using the isolators with tubular mandrels 214 a far greater strength is realized than prior techniques, which required liners to be slotted to reduce expansion force while sacrificing collapse resistance. The sandwich screens of the present invention can withstand differential pressures of 2–3000 PSI as compared to other structures such as those expanded by rollers where resistance to collapse is only in the order of 2–300 PSI.

In another expansion technique, the mandrel 214 can be made from material which, when subjected to electrical energy increases in dimension to force the sealing sleeve 216 into sealing contact with the borehole.

The use of an inflatable technique to expand the isolators and screens allows flexibility in the direction of expansion i.e. either up-hole or down-hole. It further allows selective expansion of the screens, using a variety of techniques, followed by subsequent isolator expansion by the preferred use of the expansion assembly E.

The length of the inflatable is inversely related to its sensitivity to borehole variation and is directly related to the speed with which the isolator is expanded. The screens can be expanded with bladder 38 to achieve localized or more extensive formation fracturing. Overall, higher forces for expansion can be delivered using the expansion assembly E than other expansion techniques, such as cone expansions. The inflatable technique can vary the force applied to create uniformity in fracture effect when used in a well bore with differing hardness or shape variations.

The inflatable expansion can be accomplished using a down hole piston that is weight set or actuated by an applied force through the work string. If pressure is used to actuate a down hole piston, a pressure intensifier can be fitted adjacent the piston to avoid making the entire work string handle the higher piston actuation pressures.

The isolators can have constant or variable wall thickness and can be cylindrically shaped or longitudinally corrugated.

The above description is illustrative of the preferred embodiment and the full scope of the invention can be determined from the claims, which appear below.

We claim:

1. A well completion method for isolating at least one zone, comprising:

running into the wellbore a string with at least one isolator in conjunction with a tool which allows flow from the surrounding formation into the string;

expanding said isolator and said tool in said wellbore;

running in an anchor with said string;

setting the anchor before said expanding; and releasing the string from the anchor before said expanding.

2. A well completion method for isolating at least one zone, comprising:

running into the wellbore a string with at least one isolator in conjunction with a tool which allows flow from the surrounding formation into the string;

expanding said isolator and said tool in said wellbore;

running in an expansion assembly comprising an inflatable with said string; and expanding said at least one isolator at least in part with said inflatable.

3. The method of claim 2, comprising:

selectively deflating and moving said inflatable for repositioning;

continuing expansion of said at least one isolator or tool by re-inflating said inflatable after said repositioning.

4. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

limiting the amount of expansion with a device fitted to said mandrel.

5. The method of claim 4, comprising:

using a woven sleeve around said mandrel that locks up after a predetermined amount of expansion of said mandrel as said device.

6. The method of claim 4, comprising:

using a strain sensor as said device;

transmitting, in real time, the sensed strain to the surface; and determining the amount of expansion from said sensed strain.

7. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

providing radially extending members from said mandrel into said resilient sealing sleeve to resist extrusion of said resilient sleeve after expansion of said mandrel.

8. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

providing an embedded ring located adjacent at least one end of said resilient sleeve to resist extrusion of said sleeve after expansion of said mandrel.

9. The method of claim 8, comprising:

varying the stiffness of said ring along its length.

10. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

providing exterior undulations on said mandrel;

providing a cylindrically shaped outer surface on said resilient sleeve;

converting said cylindrical shape of the outer surface of said resilient sleeve to an undulating shape upon expansion of said mandrel.

11. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

providing a void between said mandrel and said resilient sealing sleeve;

placing a deformable material or a particulate material in said void;

using said deformable material or said particulate material to aid said resilient sleeve conform to the wellbore shape on expansion of said mandrel.

12. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

pre-cooling said resilient sealing sleeve below ambient temperature before insertion into the wellbore.

13. A well completion method for isolating at least one zone, comprising:

running into the wellbore a string with at least one isolator in conjunction with a tool which allows flow from the surrounding formation into the string;

expanding said isolator and said tool in said wellbore;

circulating through said string during run in;

closing off circulation passages;

building pressure in said string;

using pressure in said string to expand said at least one isolator, at least in part.

14. A well completion method for isolating at least one zone, comprising:

running into the wellbore a string with at least one isolator in conjunction with a tool which allows flow from the surrounding formation into the string;

expanding said isolator and said tool in said wellbore;

providing an inflatable on said string to expand said at least one isolator at least in part.

15. The method of claim 14, comprising:

forming said at least one isolator from an un-perforated mandrel covered by a resilient sealing sleeve;

initially expanding said mandrel with pressure and then completing the expansion with said inflatable.

16. The method of claim 14, comprising:

forming at least one of said isolators from an un-perforated mandrel covered by a resilient sealing sleeve;

initially expanding said mandrel mechanically with a cone-type device and then completing the expansion with said inflatable.

17. The method of claim 14 comprising:

expanding said tool into contact with the formation; and fracturing the formation by said expanding.

18. The method of claim 14, comprising:

providing at least two isolators disposed above and below said tool;

providing at least one screen as said tool;

expanding at least one of said isolators and said screen at least in part with said inflatable.

19. The method of claim 17, comprising:

fracturing the formation by said expanding of said screen.

20. A well completion method for isolating at least one zone, comprising:

running into the wellbore a string with at least one isolator in conjunction with a tool which allows flow from the surrounding formation into the string;

expanding said isolator and said tool in said wellbore;

fully expanding said at least one isolator solely with at least one inflatable;

regulating the volume of incompressible fluid delivered to said inflatable as a way to limit expansion of said at least one isolator.

21. A well completion method for isolating at least one zone, comprising:

running into the wellbore a string with at least one isolator in conjunction with a tool which allows flow from the surrounding formation into the string;

expanding said isolator and said tool in said wellbore;

fully expanding said at least one isolator solely with at least one inflatable;

using a screen as said tool;

expanding said screen with said inflatable;

pressure testing, after expansion, the sealing contact against the wellbore of said at least one isolator, through said screen.

22. A well completion method for isolating at least one zone, comprising:

running into the wellbore a string with at least one isolator in conjunction with a tool which allows flow from the surrounding formation into the string;

expanding said isolator and said tool in said wellbore;

fully expanding said at least one isolator solely with at least one inflatable;

performing said expanding of said at least one isolator and said tool in a single trip into the wellbore;

running in an anchor with said string;

setting the anchor before said expanding said inflatable;

releasing the string from the anchor before actuation of the inflatable;

removing said inflatable from the wellbore with said string.

23. A well completion method for isolating at least one zone, comprising:

running into the wellbore a string with at least one isolator in conjunction with a tool which allows flow from the surrounding formation into the string;

expanding said isolator and said tool in said wellbore;

expanding said tool into contact with the formation; and fracturing the formation by said expanding.

24. A well completion method for isolating at least one zone, comprising:

running into the wellbore a string with at least one isolator in conjunction with a tool which allows flow from the surrounding formation into the string;

expanding said isolator and said tool in said wellbore;

forming said at least one isolator from an un-perforated mandrel covered by a resilient sealing sleeve;

expanding said tool into contact with the formation; and fracturing the formation by said expanding.

* * * * *